US007159635B2

(12) United States Patent
Holt et al.

(10) Patent No.: US 7,159,635 B2
(45) Date of Patent: Jan. 9, 2007

(54) LIFT CORD SPOOL FOR COVERINGS FOR ARCHITECTURAL OPENINGS

(75) Inventors: Ronald Holt, Westminster, CO (US); Stephen T. Wisecup, Erie, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 200 days.

(21) Appl. No.: 10/874,490

(22) Filed: Jun. 22, 2004

(65) Prior Publication Data

US 2004/0261954 A1 Dec. 30, 2004

Related U.S. Application Data

(60) Provisional application No. 60/482,902, filed on Jun. 25, 2003.

(51) Int. Cl.
*A47H 5/02* (2006.01)

(52) U.S. Cl. ..... 160/84.05; 160/170

(58) Field of Classification Search ..... 160/84.04, 160/84.05, 170, 171, 193, 321
See application file for complete search history.

(56) References Cited

U.S. PATENT DOCUMENTS 4,484,613 A * 11/1984 Timoschuk ..... 160/193
5,320,154 A * 6/1994 Colson et al. ..... 160/121.1
5,328,113 A 7/1994 de Chevron Villette et al. ..... 242/388
6,129,131 A 10/2000 Colson ..... 160/84.02
6,325,131 B1 * 12/2001 Dekker et al. ..... 160/170
6,588,480 B1 * 7/2003 Anderson ..... 160/170
6,622,769 B1 * 9/2003 Judkins ..... 160/84.05
6,655,441 B1 * 12/2003 Wen et al. ..... 160/168.1 P
6,659,156 B1 * 12/2003 Wen et al. ..... 160/168.1 P

FOREIGN PATENT DOCUMENTS

JP 2004-308371 11/2004

* cited by examiner

*Primary Examiner*—David Purol
(74) *Attorney, Agent, or Firm*—Dorsey & Whitney LLP

(57) ABSTRACT

A spool forming part of a lift cord drum for a covering for an architectural opening has a generally cylindrical body about which the lift cord is adapted to be wrapped and a frustoconical end encouraging the wrapped cord to shift in a predetermined direction. A longitudinal slot in the cylindrical body retains one end of the lift cord and allows the end of the lift cord to slide along the slot as wrapped cord is increased or decreased so as to minimize the possibility of the cord becoming entangled in itself.

17 Claims, 10 Drawing Sheets

LIFT CORD SPOOL FOR COVERINGS FOR ARCHITECTURAL OPENINGS

CROSS-REFERENCE TO RELATED APPLICATION

This application claims priority to U.S. provisional application No. 60/482,902, filed Jun. 25, 2003, hereby incorporated by reference in its entirety as though fully set forth herein.

BACKGROUND OF THE INVENTION

1. Field of the Invention

The present invention relates generally to retractable coverings for architectural openings and more particularly to a spool on which a lift cord or other flexible element for such a covering is wrapped.

2. Description of the Relevant Art

Coverings for architectural openings have taken different forms for many years. Early forms of such coverings were simply fabric draped in different manners across an architectural opening such as a window, door, archway, or the like. More sophisticated coverings have involved and include retractable coverings such as roller shades, venetian blinds, collapsible cellular shades and the like. Venetian blinds and some collapsible cellular shades are moved between extended and retracted positions across the architectural opening by a lift cord or other similar flexible element that extends from the headrail downwardly through the covering where it is anchored to a bottom rail. To retract the covering, the lift cord is wrapped around a drum in the headrail by rotating the drum and thereby causing the bottom rail to rise as the lift cord is wrapped about the drum.

As will be appreciated, any time a lift cord is wrapped around a drum, it is prone to becoming entangled in itself and, accordingly, systems have been developed for minimizing entanglement of lift cords about the drums on which they are wrapped. One such system involves shifting the drum linearly as it is being rotated so that the cord is fed sequentially to the drum along the length of the drum surface so that the lift cord is smoothly wrapped around the drum. An example of such a system is disclosed in U.S. Pat. No. 6,129,131 entitled Control System for Coverings for Architectural Openings, which is of common ownership with the present invention.

Some lift cord systems are also designed so that the cord is fed to one end of the drum while it is anchored to the opposite end of the drum creating a catenary in the cord from one end of the drum to the other. These systems work acceptably as long as the catenary is maintained fairly taut. If it is allowed to become slack, the lift cord can easily become undesirably entangled with itself.

It is to provide an improvement over prior art systems for wrapping a lift element about a rotating drum that the present invention has been developed.

BRIEF SUMMARY OF THE INVENTION

The present invention relates to a lift cord drum for use in coverings for architectural openings wherein a lift cord or other flexible element can be dependably wrapped on the drum. The wrapping occurs during retraction of the covering. The drum includes (1) a spool having a generally cylindrical body on which the lift cord is wrapped and an internal core for attachment to a horizontal drive rod typically found in retractable coverings for architectural openings and (2) a shell disposed immediately adjacent to the outer surface of the cylindrical body so as to discourage more than a single layer of wrap on the cylindrical body.

The spool has an elongated slot extending axially along the cylindrical body from one end of the cylindrical body to near the opposite end. The opposite end of the generally cylindrical body is flared in a frustoconical configuration so that lift cord fed to that end of the spool is encouraged to move as it is wrapped toward the one end of the spool. One end of the lift cord is secured to the spool with a knot disposed internally of the spool so that the cord projects radially outwardly through the slot and such that the cord can slide along the slot during operation of the drum.

The drum is mounted in the headrail so that lift cord is fed thereto at a fixed location immediately adjacent to the frustoconical end of the spool whereby as the spool is rotated about its longitudinal axis, the lift cord is wrapped around the spool and will automatically accumulate toward the one end of the spool as is encouraged by the slope of the frustoconical surface upon which it is wrapped. The knotted end of the cord secured to the spool slides along the slot adjacent to the first wrap of cord whether the cord is being wrapped about the spool or unwrapped so that the catenary between the knotted end of the cord and the location where the cord is fed to the spool is maintained at a minimum to avoid entanglement of the cord.

Other aspects, features, and details of the present invention can be more completely understood by reference to the following detailed description of a preferred embodiment, taken in conjunction with the drawings, and from the appended claims.

DETAILED DESCRIPTION OF THE INVENTION

Figure 1:
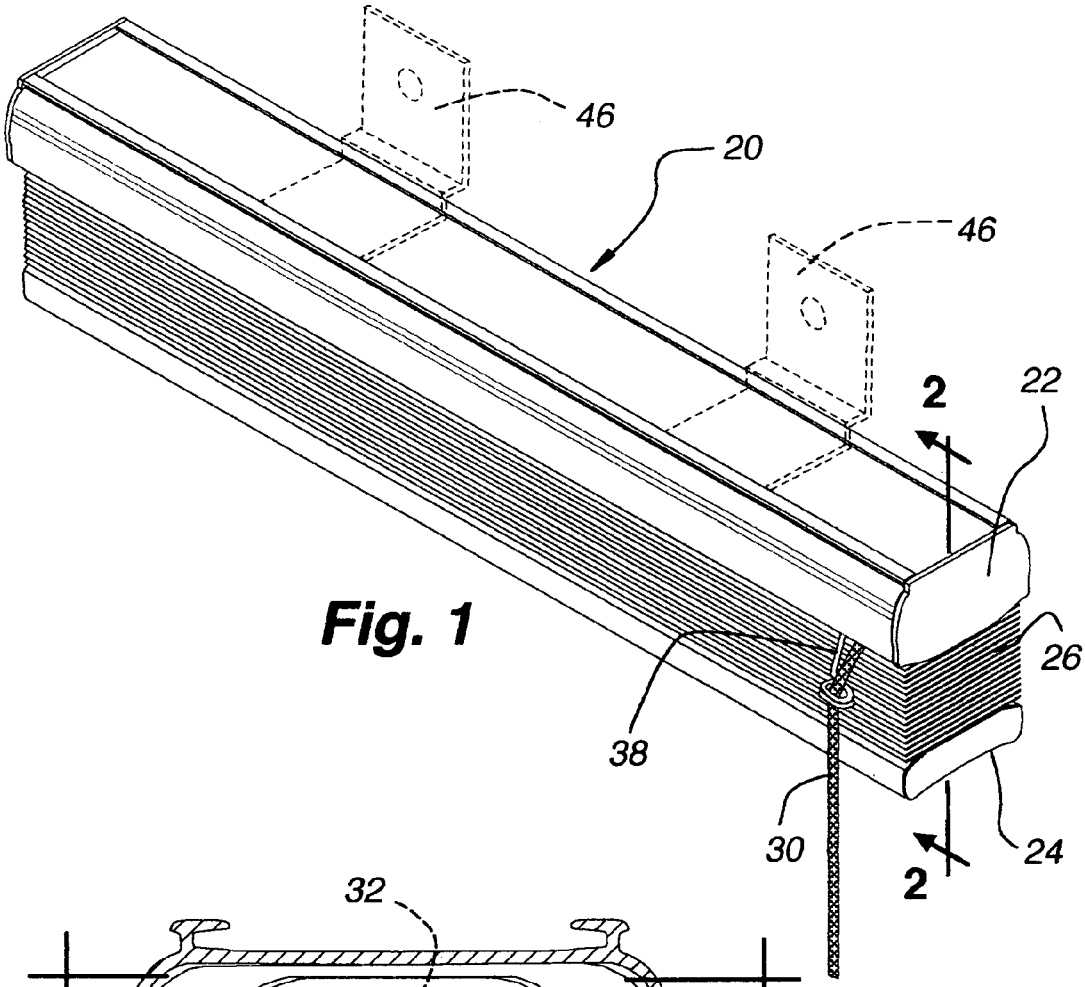
FIG. 1 is an isometric view of a covering for an architectural opening incorporating the lift cord drum of the present invention with the covering shown in a fully retracted position and with brackets for supporting the covering in an architectural opening shown in dashed lines.
Figure 2:
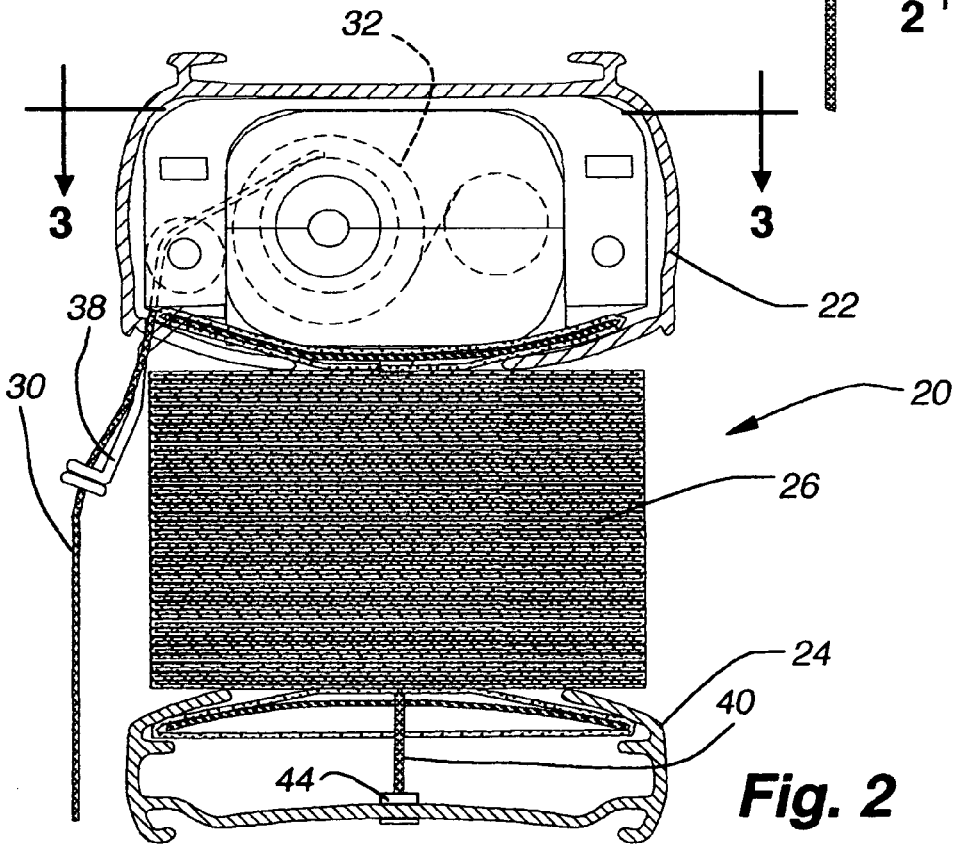
FIG. 2 is an enlarged section taken along line 2—2 of FIG. 1.
Figure 4:
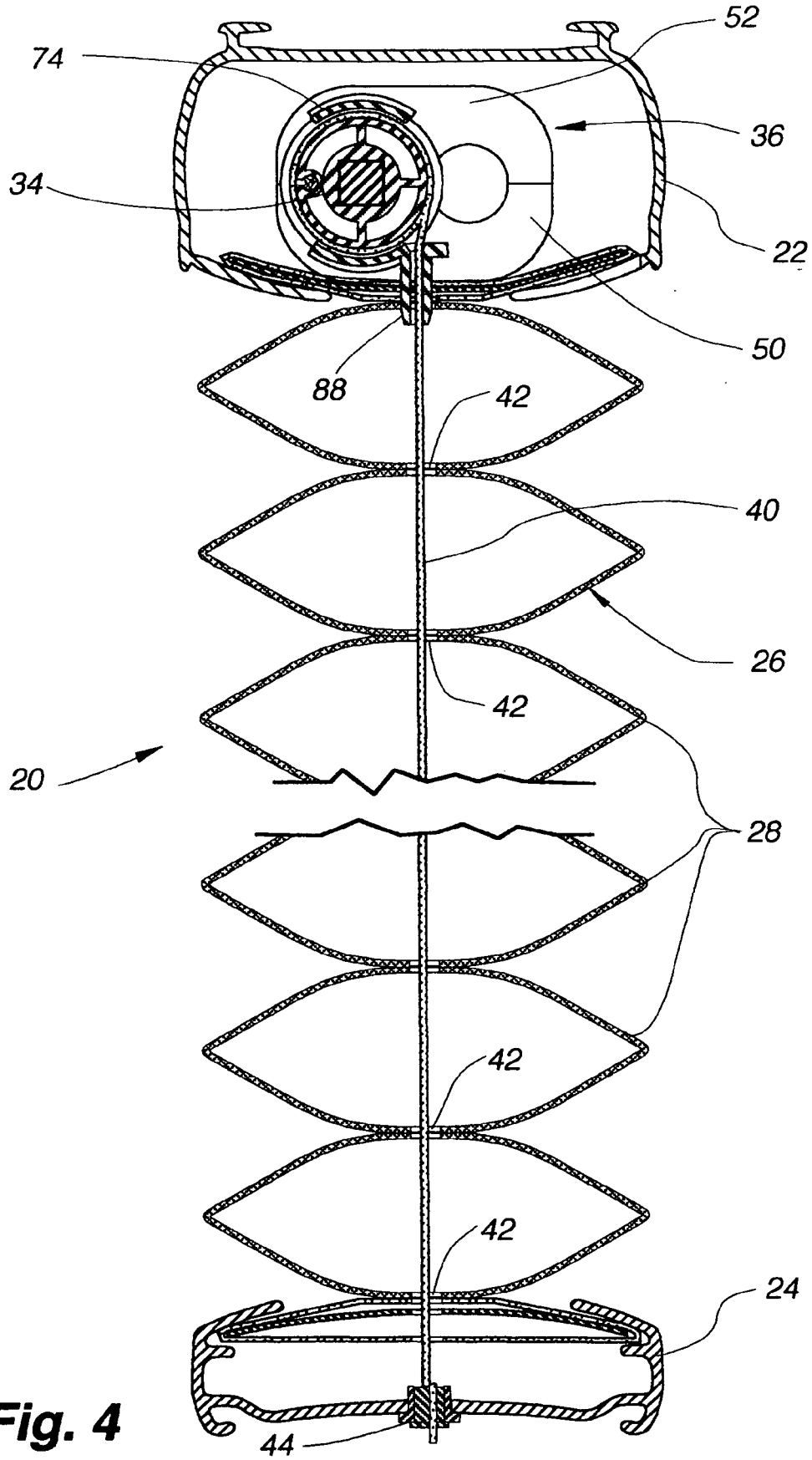
FIG. 4 is a section taken along line 4—4 of FIG. 3.

A cellular retractable covering 20 for an architectural opening is seen best in FIGS. 1, 2 and 4 to include a headrail 22, a bottom rail 24, and a shade structure in the form of a cellular fabric 26 secured to the rails and extending therebetween. As is best appreciated by reference to FIG. 4, the cellular fabric consists of a plurality of horizontally disposed cells 28 which are adhesively secured together. The cells are transversely collapsible so that when the covering is moved from an extended position of FIG. 4 to a retracted position of FIGS. 1 and 2, the cells are fully collapsed and neatly stacked between the headrail and the bottom rail.

Figure 3:
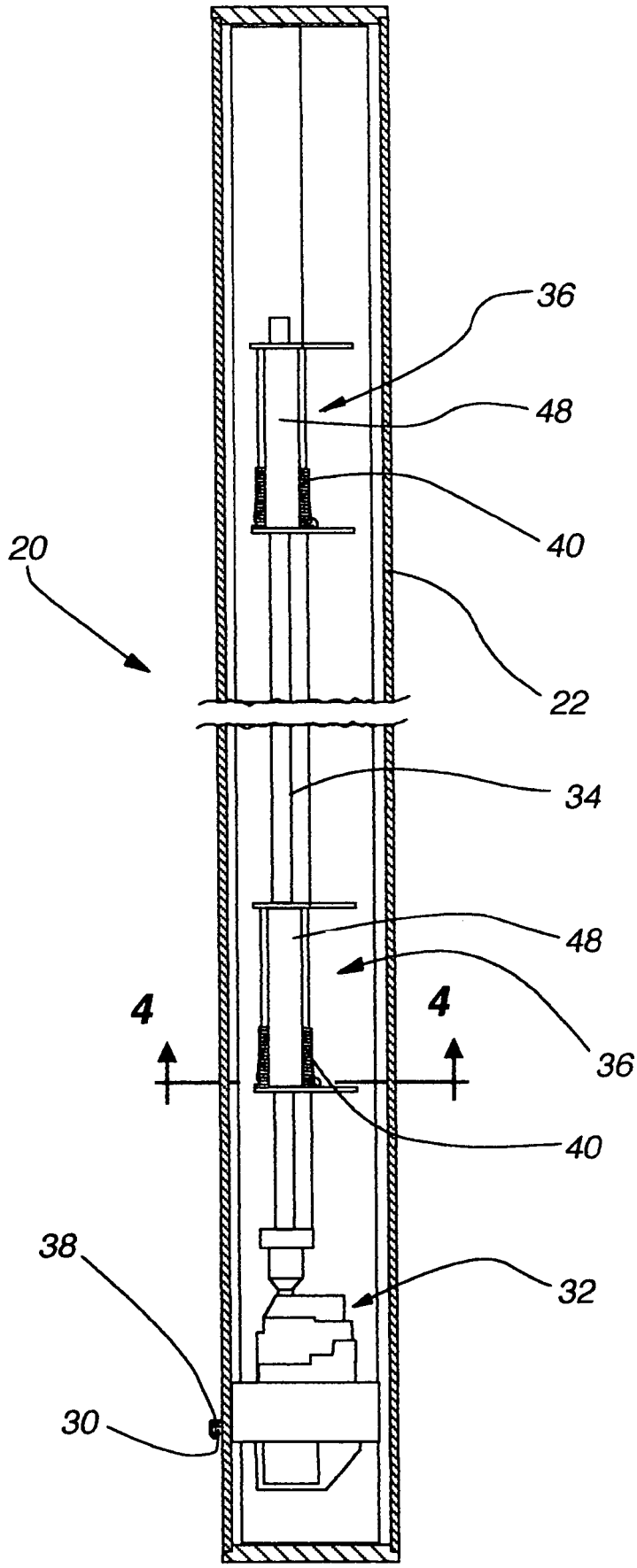
FIG. 3 is a section taken along line 3—3 of FIG. 2.
Figure 5:
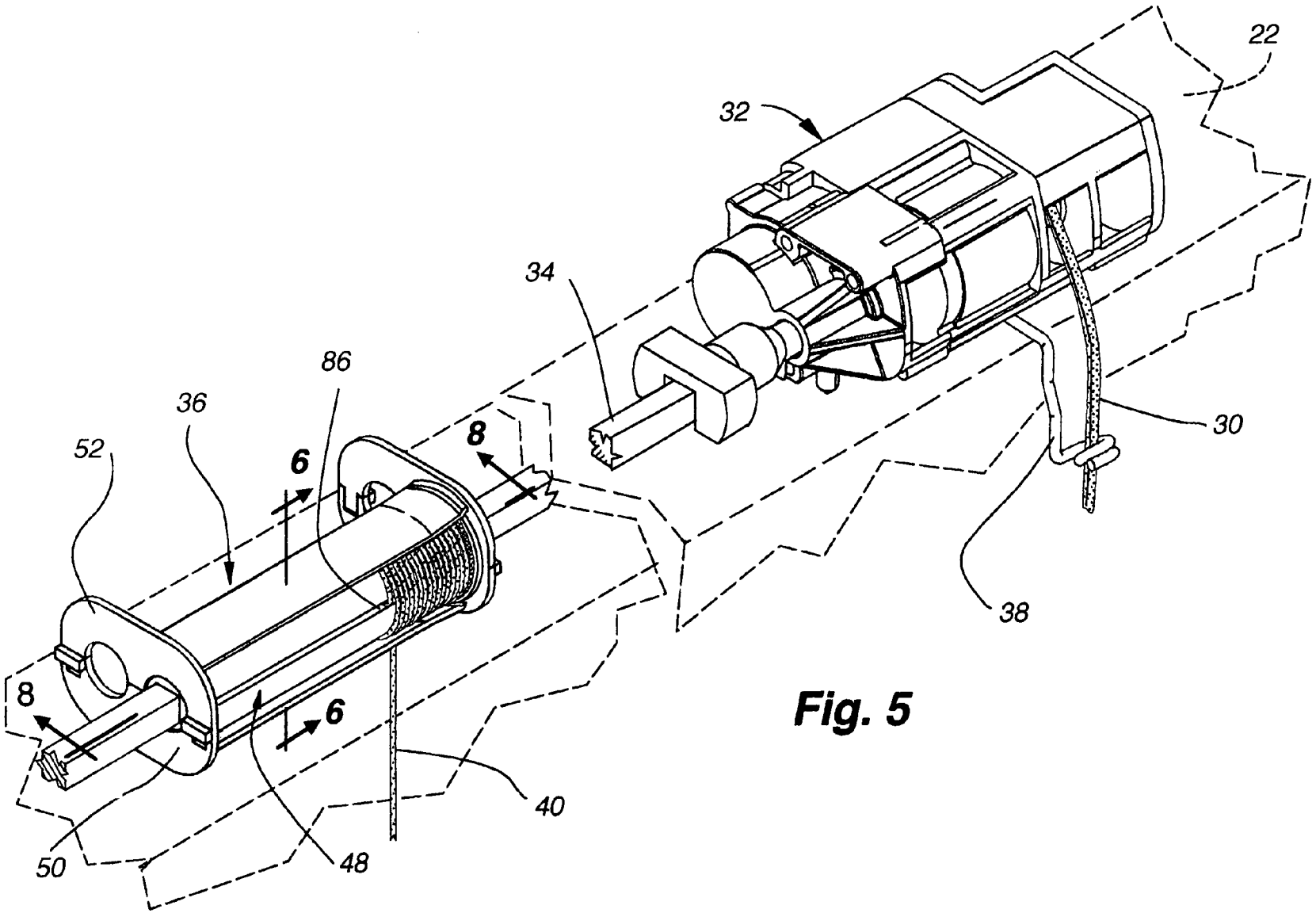
FIG. 5 is a fragmentary isometric showing a portion of the headrail in dashed lines with the lift cord drum of the present invention shown associated with a drive system for rotating the drum.

The covering 20 is moved between extended and retracted positions by operation of a control cord 30 as seen in FIGS. 1 and 2, which is designed to operate a drive element 32 as seen in FIGS. 2, 3, and 5, which in turn rotates a horizontally disposed drive rod 34 in the headrail 22 of the covering. The drive rod is operatively associated with a lift cord drum 36 of the present invention for rotation therewith in a manner to be described in more detail later.

The drive element 32 could be any drive element commonly found in coverings for architectural openings for rotating the drive rod 34 but for purposes of the present disclosure, the drive element shown is of the type described and disclosed in detail in U.S. Pat. No. 6,129,131 issued Oct. 10, 2000, which is commonly owned with the present application and the disclosure therein is hereby incorporated by reference. In the drive element 32, the control cord 30 is a single cord that can be reciprocally pulled downwardly a predetermined distance and will automatically retract upwardly for a subsequent cycle. During each pull stroke of a cycle, the drive rod 34 is rotated in a first direction, while in a recoil or retract stroke, the drive rod remains stationary so that in a ratchet-like manner, successive pull/recoil cycles cause the drive rod to intermittently rotate in the first direction. The control cord passes through a loop in a trigger arm 38 which can be shifted to release a brake (not shown) for the drive rod and when released, the weight of the bottom rail 24 causes the bottom rail to drop by gravity thereby extending the cellular fabric 26 while the drive rod is freely rotating in an opposite direction to that in which it is driven by the pull cord.

As will be described in more detail later, the drive rod 34 carries one or more lift cord drums 36 (FIG. 3) depending upon the width of the covering 20, and each drum is associated with a lift cord 40. The lift cords extend from an upper end that is connected to a drum 36 downwardly through openings 42 (FIG. 4) provided in the cellular fabric 26 and finally through the bottom rail 24 where it is secured to the bottom rail as seen in FIG. 2 with a conventional anchor element 44. The lengths of the lift cords 40 are equal so that the bottom rail always remains in parallel relationship with the headrail 22 and with the sill or other frame member of the window or other architectural opening in which the covering is mounted. A pair of brackets 46 are shown in FIG. 1 for anchoring the headrail to a frame member of an architectural opening even though the headrail could be supported in any suitable manner.

Figure 7:
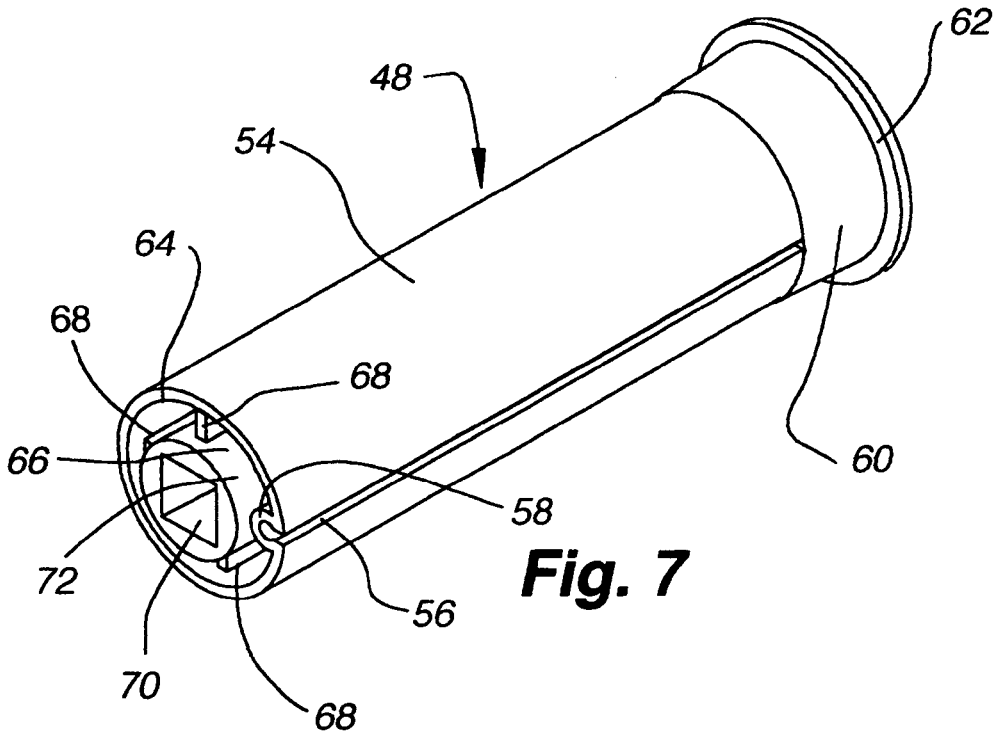
FIG. 7 is an isometric of the spool component of the drum of the present invention.
Figure 8:
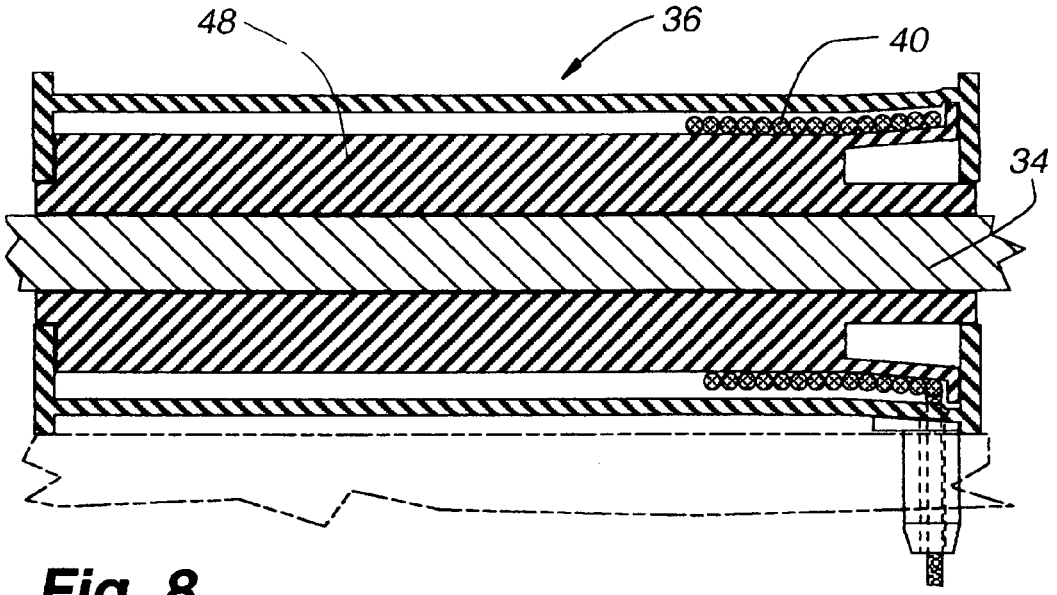
FIG. 8 is an enlarged fragmentary section taken along line 8—8 of FIG. 5.
Figure 9B:
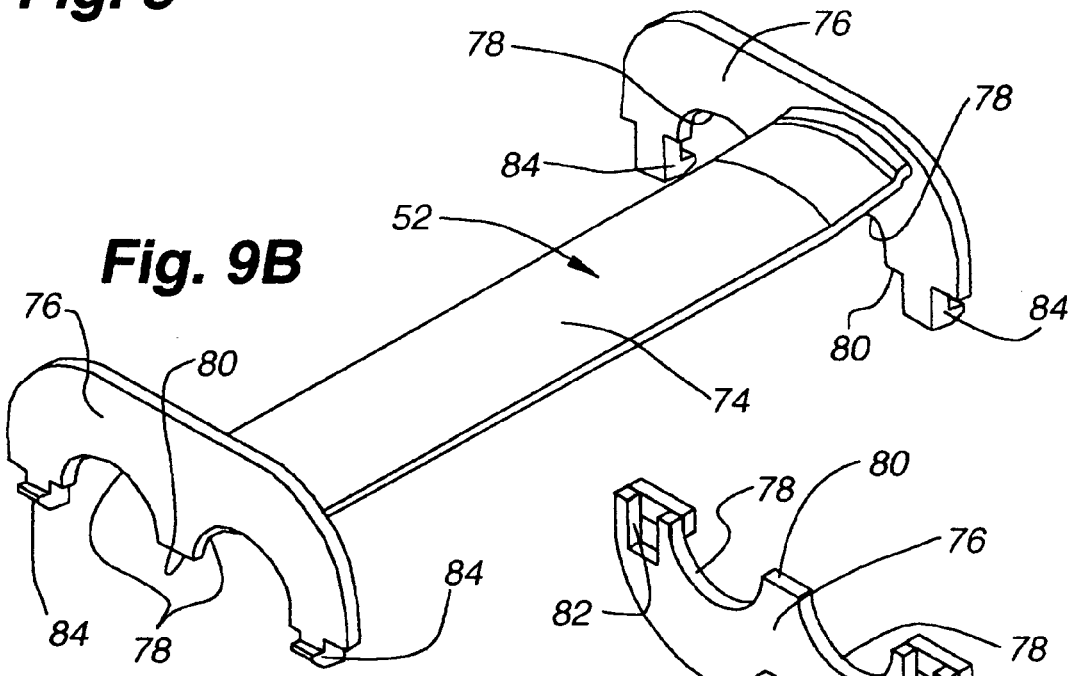
FIG. 9B is an isometric of the other element of the shell of the drum of the present invention.
Figure 9A:
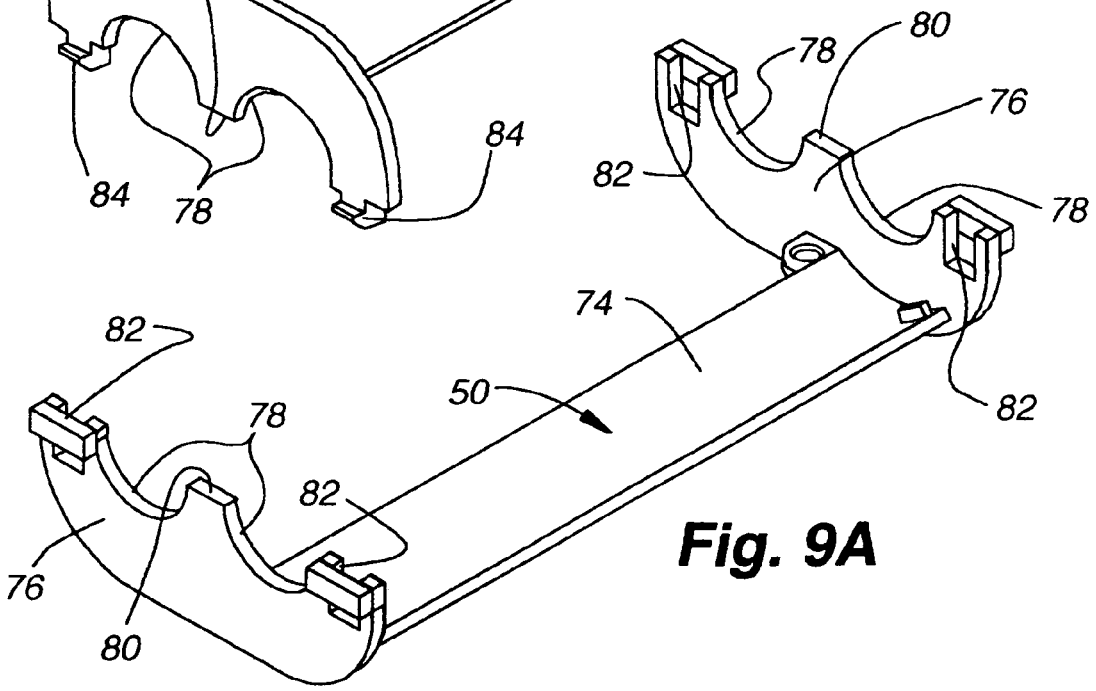
FIG. 9A is an isometric of one element of the shell of the drum of the present invention.
Figure 10:
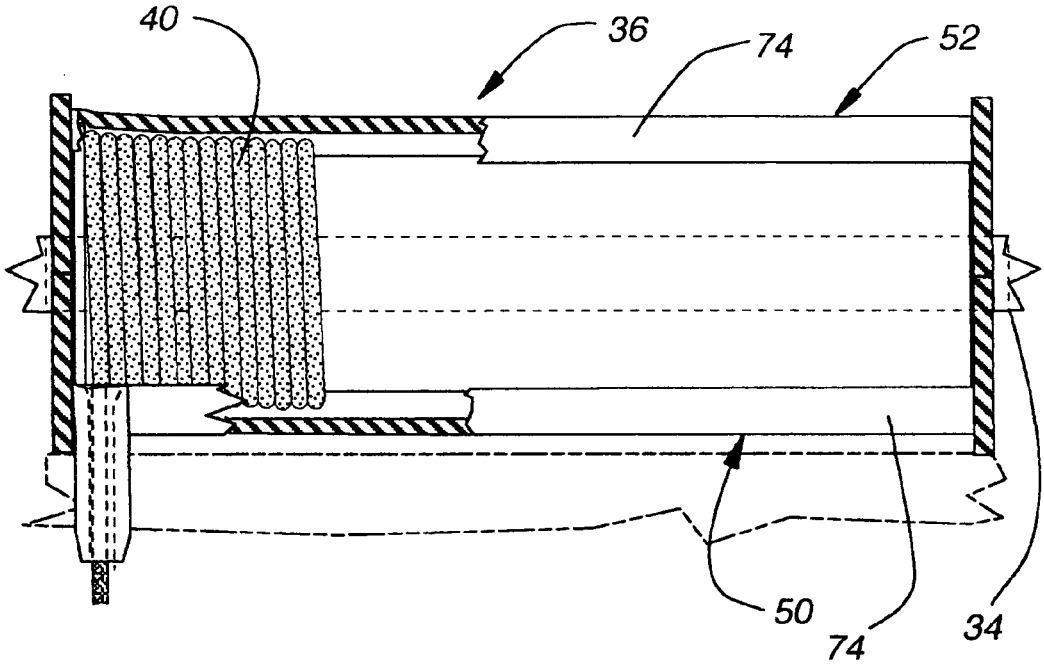
FIG. 10 is a section taken along line 10—10 of FIG. 6.
Figure 11:
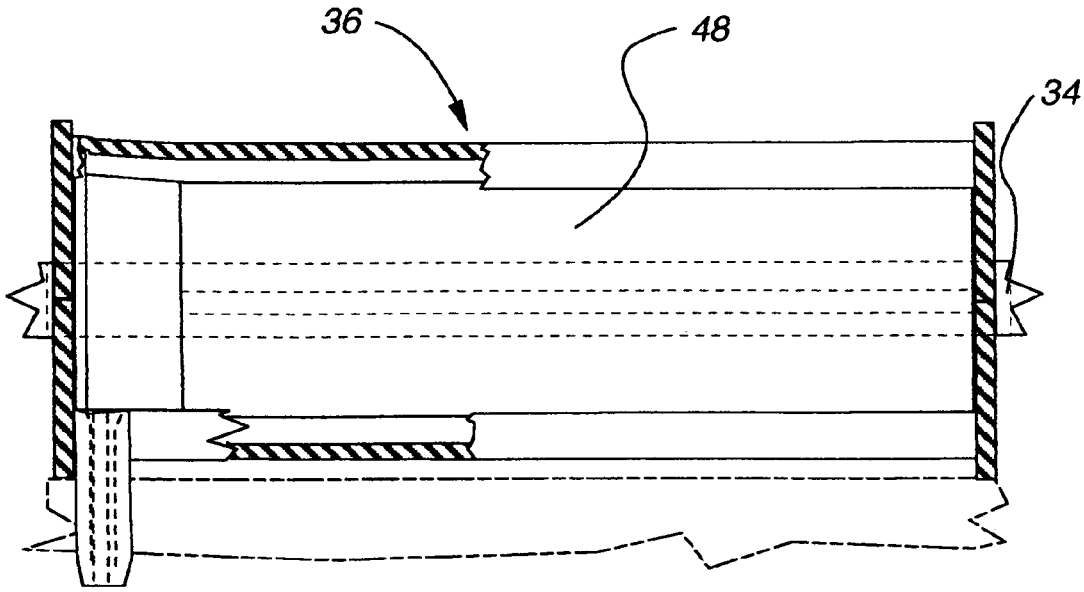
FIG. 11 is a section similar to FIG. 10 with the lift cord having been removed.
Figure 12:
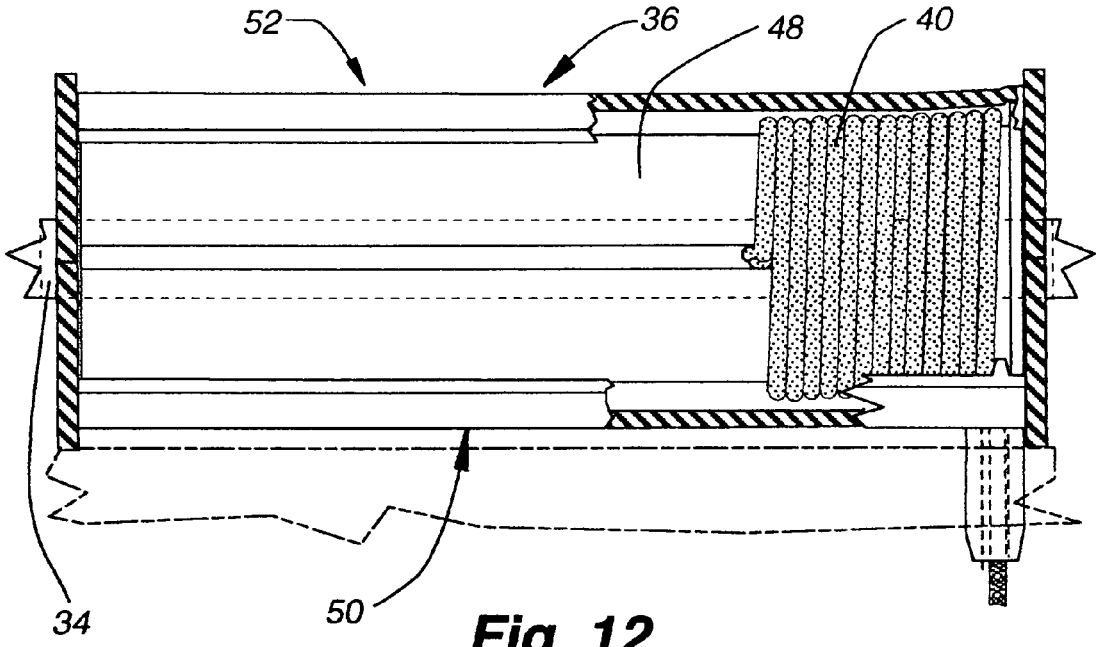
FIG. 12 is a fragmentary section taken along line 12—12 of FIG. 6.
Figure 13:
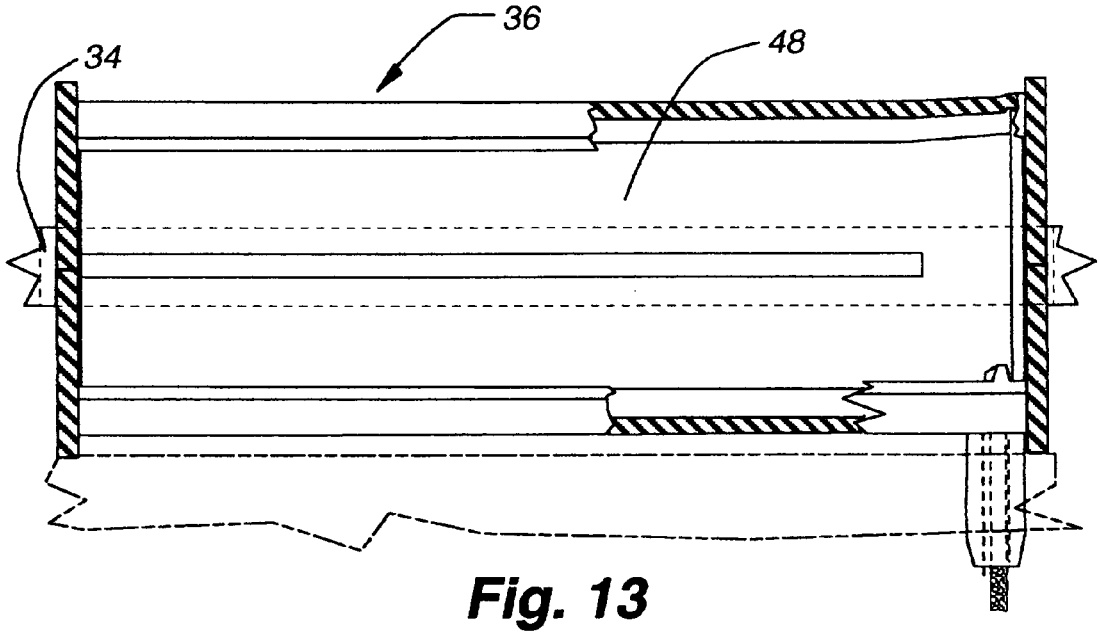
FIG. 13 is a section similar to FIG. 12 with the lift cord having been removed.
Figure 14:
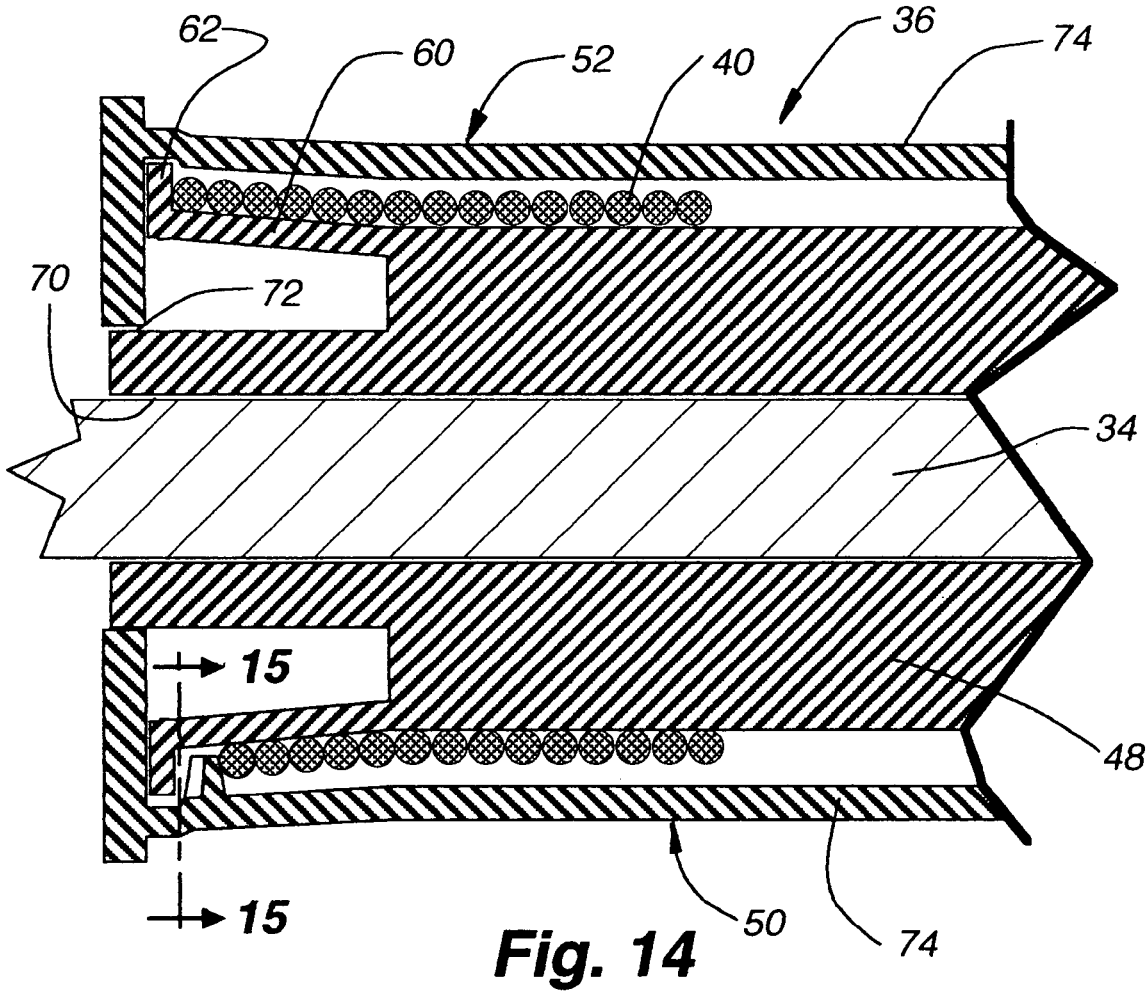
FIG. 14 is an enlarged fragmentary section taken along line 14—14 of FIG. 6.
Figure 15:
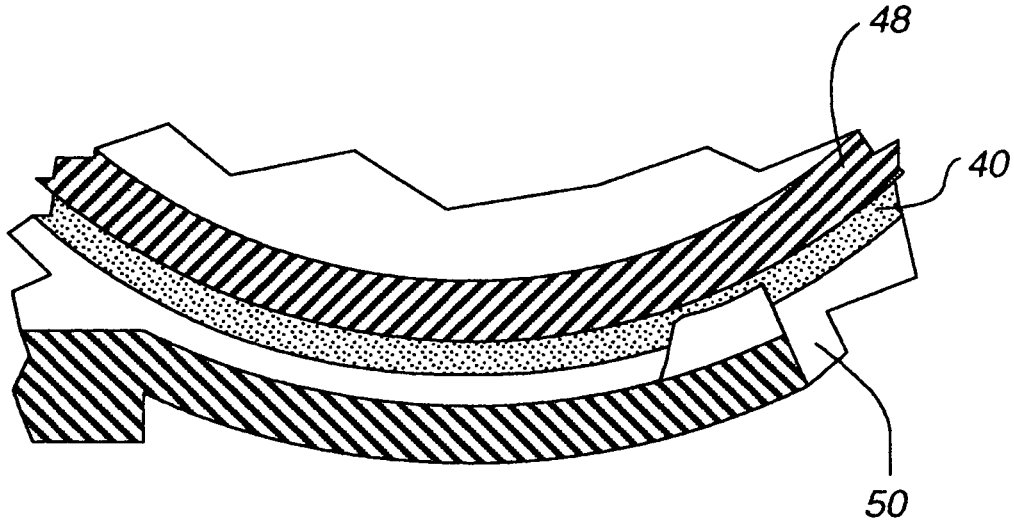
FIG. 15 is an enlarged fragmentary section taken along line 15—15 of FIG. 14.

With initial reference to FIG. 5, the lift cord drum 36 of the present invention can be seen to include a spool member 48 as seen in FIG. 7 and a pair of releasably connected shell elements 50 and 52 as shown in FIGS. 9A and 9B. The shell elements are releasably connectable to each other and releasably mountable on the spool as will be described later.

With reference to FIG. 7, the spool 48 includes an outer cylindrical body 54 having a slot 56 formed therein with the slot opening through the outer cylindrical surface of the body from a longitudinally extending groove 58 protruding inwardly from the inner surface of the cylindrical body. The groove 58 is of a larger diameter than the slot 56 for a purpose to be described later. The generally cylindrical body flares radially outwardly at one end defining a frustoconical surface 60 with the large end of the frustoconical surface being contiguous with a flange 62 that extends radially outwardly from the frustoconical surface. The slot 56 formed in the generally cylindrical body extends from an open end 64 of the spool opposite from the flange to the location at which the frustoconical surface commences.

The cylindrical body is held in radially spaced relationship from a cylindrical core 66 by a plurality of radially and longitudinally extending ribs 68 so that the generally cylindrical body 54 is spaced from the cylindrical core 66 allowing for the groove 58 in the cylindrical body. The cylindrical core has an axial passageway 70 of square cross section which mates with the cross section of the drive rod so that the spools 48 will rotate about their longitudinal axis in unison with the drive rod 34. The cylindrical core is slightly longer than the cylindrical body so as to protrude a small distance from each end to define bearing surfaces 72. The entire spool can be made of any suitable material even though a hard plastic has been found acceptable.

The two shell elements 50 and 52 shown in FIGS. 9A and 9B can each be seen to include an elongated bar 74 of slightly arcuate cross section so as to conform to the curvature of the cylindrical body 54 but having a slightly larger radius of curvature. The bar 74 is integral at opposite ends with end plates 76 with each end plate having a pair of side-by-side semi-circular recesses 78 opening outwardly from an edge 80 thereof and connector components at opposite ends of the end plates. The connector components 82 on one shell element 50 are openings adapted to releasably receive a catch 84 which forms the connector component of the other shell element 52 so that the shell elements can be releasably snapped together with the arcuate bars 74 being in confronting relationship and in surrounding relationship with the spool 48. The spool is adapted to be rotatably seated between the shell elements by positioning the bearing surfaces 72 of the core 66 in one pair of the semi-circular recesses 78 in the end plates 76. Of course, when the shell elements are connected together, the semi-circular recesses define circular openings through the assembled shell for receiving the bearing surfaces. Accordingly, when fully assembled as shown in FIG. 5, the spool 48 is rotatably mounted on the assembled shell elements 50 and 52 between the arcuate bars 74 and in spaced relationship therewith. The spacing between the arcuate bars and the cylindrical outer surface of the spool is preferably only slightly greater than the diameter of a lift cord so as to discourage overlapping of lift cord 40 when the lift cord is wrapped around the cylindrical surface as will be described hereafter.

Figure 6:
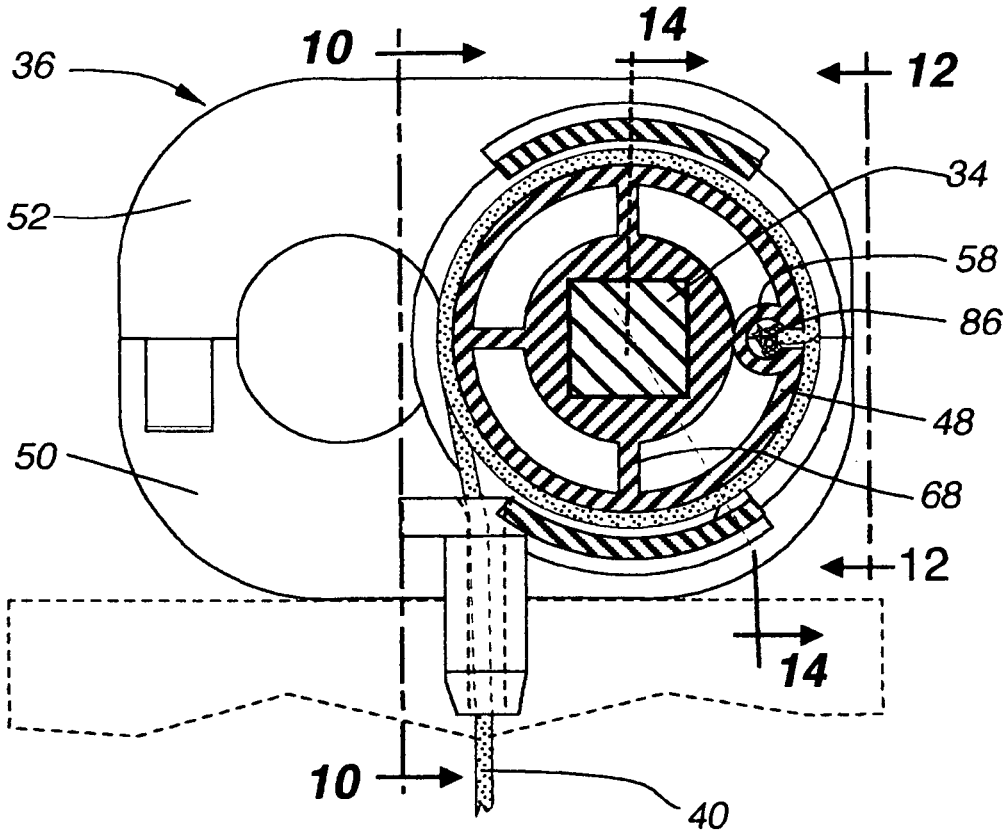
FIG. 6 is an enlarged section taken along line 6—6 of FIG. 5.

As probably best seen in FIG. 6, the upper end of the lift cord 40 which is connected to the drum is knotted at 86 and the knot is inserted into the relatively large diameter groove 58 provided in the spool 48. Of course, the knot can be fed into the groove from the open end 64 of the spool opposite the end with the flange 62. The slot 56 has a width greater than the diameter of the lift cord so the lift cord with the knotted end is free to slide along the length of the spool within the slot.

The spools 48 are fixedly positioned on the drive rod 34 in any suitable manner so as not to slide along the length of the drive rod and are positioned so the lift cord 40 which passes through a sleeve 88 (FIG. 4) mounted in the bottom wall of the headrail 22 is aligned with the frustoconical surface 60 of the spool immediately adjacent to the flange 62 on the spool. This is probably best seen in FIGS. 12, 13, and 16–18.

Figure 16:
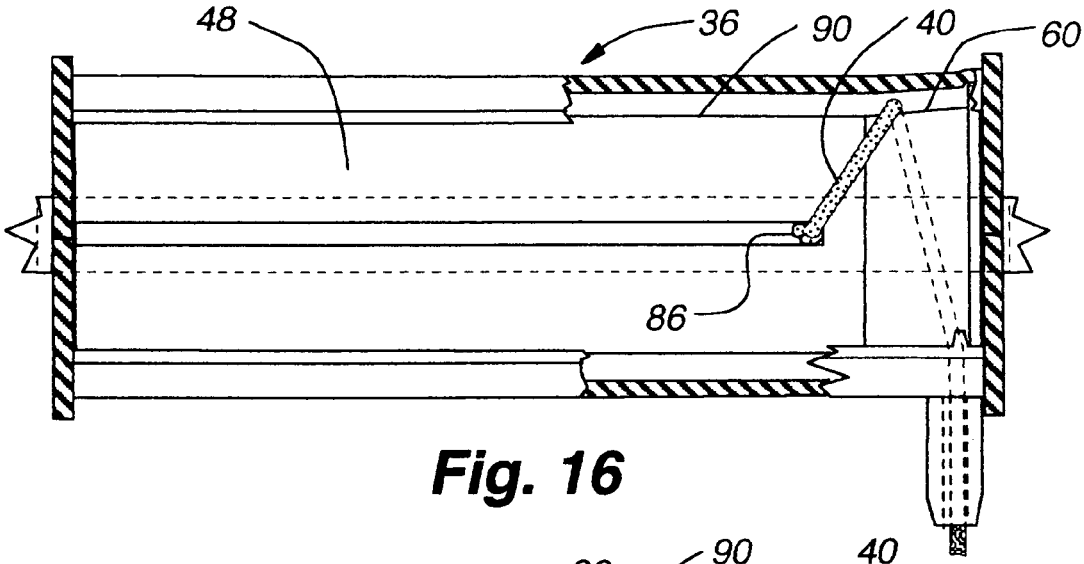
FIG. 16 is an operational sectional view similar to FIG. 12 showing the lift cord being initially wrapped onto the spool.

When the covering 20 is extended, as shown for example in FIG. 4, the bottom rail 24 is supported by the lift cords 40 and the lift cords are aligned with the frustoconical surface 60 of an associated drum 36 immediately adjacent to the flange 62 as mentioned previously. The cord extends from the sleeve 88 to the closed end of the slot 56 where the knot 86 is positioned due to the weight of the bottom rail pulling the knotted end of the lift cord along the slot to its closest location to the flange. As will be appreciated, the catenary in the lift cord, i.e. the cord extending from the knotted end 86 of the cord to the sleeve 88, is of a minimum length. As the spool 48 is rotated with the drive rod 34, the lift cord begins to wrap around the frustoconical surface of the spool as shown in FIG. 16 while the knotted end of the cord remains adjacent to the closed end of the slot. As more cord 40 is wrapped around the spool upon continued rotation of the drive rod, the wraps of cord about the frustoconical surface will shift to the left as viewed in FIGS. 16–18 as the diameter of the spool is reduced in that direction. Several wraps of cord can be made before the cord wraps progress onto a cylindrical wall portion 90 of the body from the frustoconical surface as each wrap of cord onto the frustoconical surface urges previous wraps to the left. Once there are enough wraps so that they pass the closed end of the slot, the knotted end of the cord is pushed to the left by the first wrap of cord so that the knotted end of the cord slides along the slot toward the open end 64 of the spool and when the cord is substantially fully wrapped onto the spool as shown in FIG. 18, the knotted end of the cord has been pushed to the left toward the open end of the spool a considerable distance.

Figure 17:
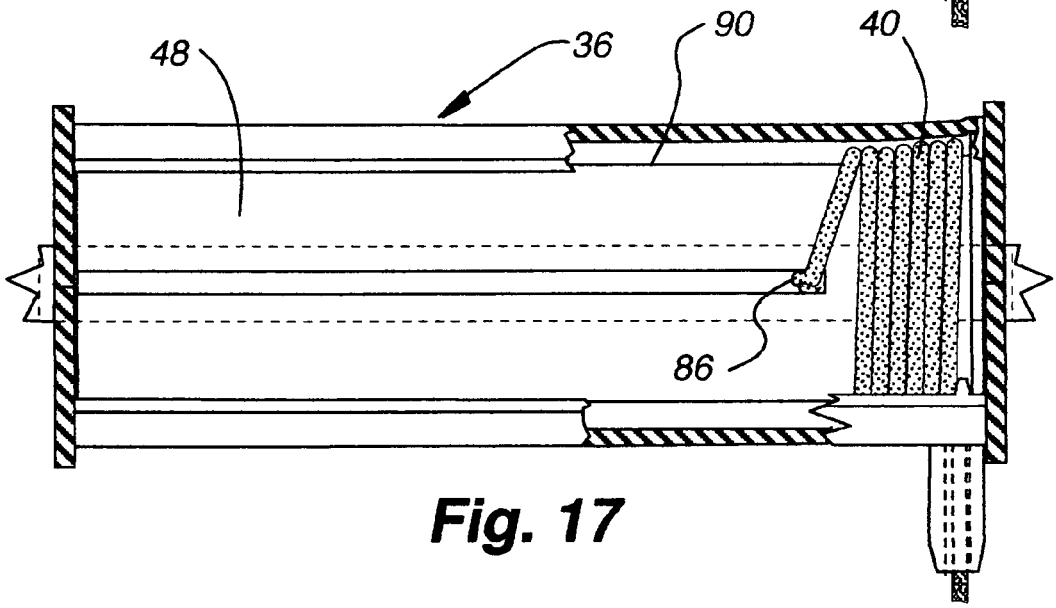
FIG. 17 is an operational section similar to FIG. 16 with the lift cord being further wrapped about the spool.
Figure 18:
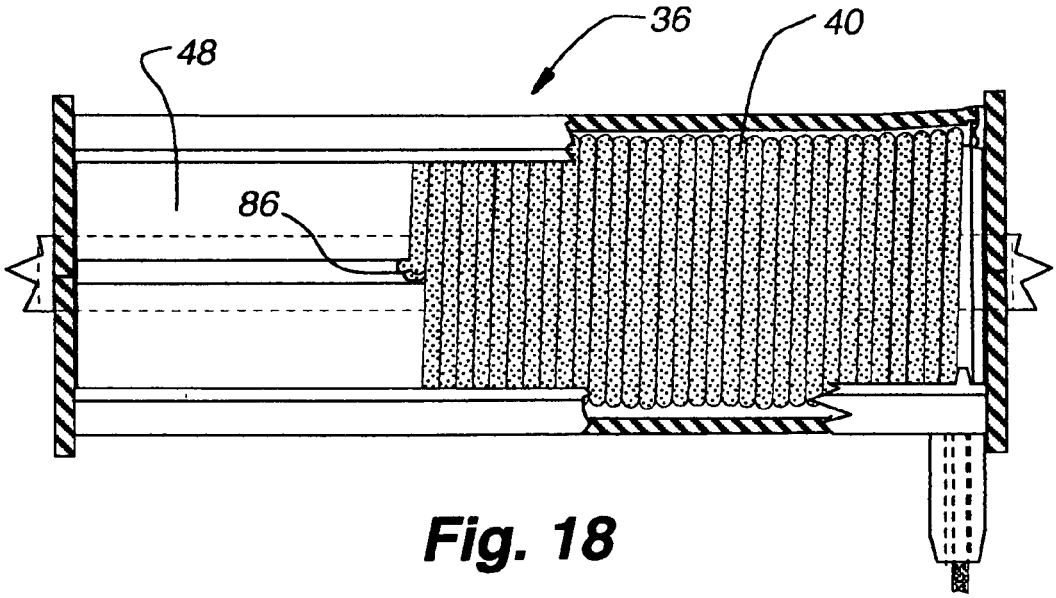
FIG. 18 is an operational section similar to FIGS. 16 and 17 with the cord further wrapped about the spool.

The reverse is true when the cord is unwrapped from the spool as when the bottom rail 24 is allowed to drop by gravity from the fully retracted position of FIG. 1 to the extended position of FIG. 4 as the weight of the bottom rail pulls the lift cord from the spool 48 through the sleeve 88 and as this is occurring, the wraps are encouraged to shift to the right as viewed in FIGS. 16–18 pulling the knotted end of the lift cord therewith.

It will be appreciated that the use of the slot 56 in the spool 48 encourages the length of the catenary to remain at a minimum to minimize the possibility of the lift cord becoming entangled with itself. The limited spacing of the shell elements 50 and 52 from the outer surface of the spool 48 further inhibits entanglement.

Although the present invention has been described with a certain degree of particularity, it is understood the disclosure has been made by way of example, and changes in detail or structure may be made without departing from the spirit of invention as defined in the appended claims.

What is claimed is:

1. The combination of a spool and a lift cord for a covering for architectural openings wherein said spool comprises, an elongated generally cylindrical body having a generally cylindrical wall and an axially extending slot in said body extending a majority of the length of said body and said lift cord is elongated having an end slidably connected to said spool in said slot, whereby when the lift cord is wrapped around or removed from said spool, said end of said lift cord slides along said slot.

2. The combination of claim 1 further including an exterior frustoconical surface at one end of said generally cylindrical wall.

3. The combination of claim 2 wherein said slot is discontinuous at said frustoconical surface.

4. The combination of claim 1 further including a centered axial passage through said body.

5. The combination of claim 4 wherein said axial passage is of non-circular cross-sectional configuration.

6. The combination of claim 3 wherein said slot is continuous from the end of said generally cylindrical wall opposite said one end to its discontinuation at said frustoconical surface.

7. The combination of claim 1 further including an outer shell radially spaced from said generally cylindrical wall and being rotatably connected to said drum.

8. A covering for an architectural opening comprising in combination, a headrail, a bottom rail, a shade structure extending between and attached to said headrail and bottom rail, said headrail including a horizontally disposed drive rod, a drive system for rotating said drive rod in at least one direction and at least permitting rotation of the drive rod in an opposite direction, a flexible lift element secured at one end to said bottom rail and extending to said headrail at its other end, and a spool mounted on said drive rod for unitary rotation therewith, said spool including an elongated generally cylindrical body with a substantially cylindrical wall having an axially extending slot therein extending a majority of the lenth of said body and wherein said other end of said flexible element extends through said slot and is secured to said body so as to be slidable along said slot in the cylindrical wall, wherein when the lift cord is wrapped around or removed from said spool, said other end of said lift cord slides along said slot.

9. The covering of claim 8 further including an exterior frustoconical surface at one end of said generally cylindrical wall.

10. The covering of claim 9 wherein said slot is discontinuous at said frustoconical surface.

11. The covering of claim 8 further including a centered axial passage through said drum to receive said drive rod.

12. The covering of claim 11 wherein said axial passage and said drive rod are of mating non-circular cross-section.

13. The covering of claim 10 wherein said slot is continuous from the end of said generally cylindrical wall opposite said one end to its discontinuation at said frustoconical surface.

14. The covering of claim 8 further including an outer shell radially spaced from said generally cylindrical wall and being rotatably connected to said generally cylindrical body.

15. The covering of claim 14 wherein said outer shell is removably connected to said generally cylindrical body.

16. A spool for wrapping lift cord for a covering for architectural openings comprising in combination:

a generally cylindrical body having a generally cylindrical wall and an axially extending slot in said body, said spool further including a centered axial passage through said body and a core in said spool through which said axial passage extends, said core being radially spaced inwardly from said generally cylindrical wall and being connected thereto with ribbing.

17. A covering for an architectural opening comprising in combination:

a head rail;

a bottom rail;

a shade structure extending between and attached to said head rail and bottom rail;

said heed rail including a horizontally disposed drive rod, a drive system for rotating said drive rod in at least one direction and at least permitting rotation of the drive rod in an opposite direction, a flexible lift element secured at one end to said bottom rail and extending to said head rail at its other end, and a spool mounted on said drive rod for unitary rotation therewith, said spool including a generally cylindrical body with a substantially cylindrical wall having an axially extending slot therein and wherein said other end of said flexible element extends through said slot and is secured to said body so as to be slidable along said slot in the cylindrical wall, said spool further including a core and a centered axial passage through said core to receive said drive rod said core being radially spaced inwardly from said generally cylindrical wall and being connected thereto with ribbing.

* * * * *

UNITED STATES PATENT AND TRADEMARK OFFICE

CERTIFICATE OF CORRECTION

PATENT NO. : 7,159,635 B2
APPLICATION NO. : 10/874490
DATED : January 9, 2007
INVENTOR(S) : Ronald Holt et al.

It is certified that error appears in the above-identified patent and that said Letters Patent is hereby corrected as shown below:

Column 6, line 39, delete “lenth” and insert --length--.

Signed and Sealed this

Thirteenth Day of March, 2007

JON W. DUDAS
*Director of the United States Patent and Trademark Office*